United States Patent [19]

Umlauf

[11] Patent Number: 4,792,075

[45] Date of Patent: Dec. 20, 1988

[54] APPARATUS FOR PULLING FORWARD OR HOLDING BACK MOVING METAL STRIPS

[76] Inventor: Norbert Umlauf, Haferkamp 64, 5800 Hagen, Fed. Rep. of Germany

[21] Appl. No.: 833,815

[22] Filed: Feb. 26, 1986

[30] Foreign Application Priority Data

Mar. 16, 1985 [DE] Fed. Rep. of Germany ..... 85103072

[51] Int. Cl.[4] ..... B65H 20/00

[52] U.S. Cl. ..... 226/172; 226/196

[58] Field of Search ..... 226/172, 174, 196

[56] References Cited

U.S. PATENT DOCUMENTS

| | | | |
|---|---|---|---|
| 548,637 | 10/1895 | Greenfield | 226/172 X |
| 2,797,758 | 7/1957 | Hallden | 226/172 |
| 3,310,849 | 3/1967 | Hazelett et al. | 226/172 X |
| 3,368,728 | 2/1968 | Gudmestad | 226/172 |
| 4,039,109 | 8/1977 | Rhodes | 226/172 |
| 4,469,267 | 9/1984 | Franchuk et al. | 226/172 |
| 4,527,723 | 7/1985 | Umlauf | 226/172 |

FOREIGN PATENT DOCUMENTS 3208158 9/1983 Fed. Rep. of Germany .

*Primary Examiner*—Stanley N. Gilreath

*Assistant Examiner*—Steven M. du Bois

*Attorney, Agent, or Firm*—Toren, McGeady & Associates

[57] ABSTRACT

An apparatus for exerting a forward or rearward drag on a moving metal strip (9), for use in particular with narrow metal strips which are to be wound up together side by side and which are to have separate rearward braking drags applied to them, comprises two endless conveyor chain systems (3, 4) driven by chain wheels (23). Each of the chains of the systems is formed by a series of pivotally interconnected roller units (7) which are guided by guides (13) along a straight drag-applying zone (12) where the strip (9) is clamped between the units (7) of the systems (3, 4) and has a drag (8) applied to it. Further guide bars (17) are provided remote from the zone (12) and these bars (17) together with the chain wheels (14) and guide segments (15, 16) guide each conveyor chain (3, 4) along a path which is curved along its whole extent except where it passes through the straight drag-applying zone (12). In this way abrupt changes in direction of the chains (3, 4) are largely avoided and rattling and thus wear of, and noise from, the chains is reduced.

17 Claims, 3 Drawing Sheets

APPARATUS FOR PULLING FORWARD OR HOLDING BACK MOVING METAL STRIPS

FIELD OF THE INVENTION

This invention relates to an apparatus for exerting a forward or backward drag on moving metal strips or sheets. It is especially applicable to narrow strips which are to be wound jointly side by side onto a winding shaft in order to apply separate braking drags to each strip. The apparatus includes two oppositely disposed endlessly circulating conveyor chain systems, driven by chain wheels, which clamp the strip or sheet between roller units of the systems, the units being guided on bars in a straight drag-applying the zone.

DESCRIPTION OF PRIOR ART

Apparatus such as this, which forms a braking stand, is disclosed in German Published Patent Application No. 32 08 158. With this stand, the large pulling or restraining drag or force required to brake metal strips can be applied without harmful effects to the surface of the strip which may or may not be longitudinally divided into narrower strips. Thus, even strips having highly sensitive surfaces, for example aluminum strips, can be treated by means of this apparatus.

This is achieved mainly by feeding the chains together with the roller units into a relatively short clamping and drag-applying zone by means of straight guide bars, which also enable the clamping forces perpendicular to the surfaces of the strip to be resisted. In this manner, relatively large clamping forces can be accepted, which are necessary to enable large pulling or holding-back forces to assured without relative movement between the strip and the roller units of the conveyor chains. By inlet and outlet divergences at the starts and ends of the straight guide bars of the clamping zone, the positive guidance of the roller units is promoted. These divergences at the ends of the clamping zone avoid a sudden transition, and make possible smooth taking-over of each roller unit and also ensure positive pressing of the roller units opposite to each other in this zone. With such a braking apparatus which is intended in particular for the purpose of applying high tensile or restraining forces without surface damage to metal strips, the inlet and clamping conditions are thus of determining importance.

SUMMARY OF THE INVENTION

The main object of the present invention is to broaden the scope of use of the known apparatus described above.

Another object is to further stabilise the inlet and entraining conditions on entry of the roller units into the straight strip clamping zone of the apparatus.

To this end, according to the present invention, each conveyor chain system is guided along a curved path along its whole extent except for the drag-applying zone which remains straight. With conveyor chain systems having a curved form except for the straight entraining or drag-applying zone, with which are included also the inlet and outlet inclined sections of the otherwise straight guide bars, although in essence no supporting forces occur in the curved parts of the paths of the chains, that is with chains having mainly circular arcuate paths not merely in the region of the direction reversals, the chains which are composed of a plurality of directly coupled together roller units can move very largely free of sudden directional changes. In this way the positive parallel feeding of the opposed roller units of the chain systems into the clamping or drag-applying zone is promoted and also a much higher speed of strip movement—for example up to 1,000 m/min.—can be reached.

The free run of the chains without abrupt directional changes can be further promoted by providing each chain system with driving chain wheels only at one end of their path, preferably the end towards which the drag is applied to the strip. Preferably then part-circular direction changing and guide elements are provided at least at the outlet ends of the chain paths remote from the driving chain wheels. These elements support the chains at the outlet end of the strip. This arrangement applies for generator-type drive, and is oppositely-handed for motor-type drive. Thus, at each revolution of the conveyor chain, the chain sinks only once with its slide bushings or pins which connect the roller units into the chain wheel, which is provided with semicircular recesses for engaging the chain pins. At the opposite ends of their paths the chains can roll without abrupt transition onto the direction-changing and guide elements. The unavoidable chain movements on disengagement and engagement of the chain wheels transmitted from the chain wheels to the chains are reduced by one half and thus the life of the chains is increased.

Preferably, in each stand, across the chain paths, that is opposite to the straight, inner chain guide bars of the clamping zone, outer, circular-arc shaped guide bars are provided. These arcuate guide bars engage without abrupt transition into direction-changing curves which are constructed as tensioning elements or segments and are pivotally journalled on a drive shaft of the chain wheels at the inlet end of the clamping zone and at a distance from the guide segments at the outlet end of the clamping zone. With the tensioning segments or elements each disposed parallel adjacent to the chain wheels on the drive shaft, the chain can be so guided at the inlet end of the clamping zone that its chain axles as far as possible run beyond the engagement points of the chain with the recesses of the chain wheel. This reduces the intermittent forces upon the chain. The engagement of the chain pins in the recesses is to be expected in particular immediately adjoining the vertical position of a semicircular recess of the chain wheel along an arc dimension of approximately 10° to 15°.

Tensioning cylinders mounted in each chain system may act with their piston rods on the outer arcuate guide bars. In this way a lever effect centered on the chain wheel shafts can be achieved and the chains can be tensioned via the pivotal tensioning segments, so that the chain and drive shaft itself remains free of displacements, in particular the horizontal displacement which otherwise occur.

In order to obtain space for tensioning the chains, the straight guide bars of the clamping zone preferably end at the pulling side of the zone at a distance from the tensioning segments or elements and engage, at the opposite end, without transition into the guide segments. The direction-changing and guide segments at the strip outlet end are thus uninfluenced by adjustment movements.

Because each chain and thus the roller units which form the chain enter the clamping zone along a path inclined in the direction of strip feed, i.e. the space between the opposed chains is wedge-shaped at the entry, the roller units can be made to come into contact in a uniformly parallel manner, particularly taking into account the deformation of the elastic facings which are usually provided on the clamping faces of the roller units, upon contact with the strip. The feed of the chain of the upper chain system, for example with a slope of a fraction of 1° makes possible a specific loading which can be modified as desired exactly at that point where, due to the loadings which occur as the roller units come into contact with the strip, the greatest displacement of the facing takes place. In this region the greatest specific loadings can also be brought into action.

The careful, uniform coming of the roller units into contact with the strip in the clamping zone can be achieved also by providing the two chain systems with a different number of divisions or roller units, the lower chain preferably being made longer by one division or unit than the upper chain. The lower chain therefore runs around a longer circulating path, in order to coincide in the entraining zone with the other, upper chain and to make use in the clamping zone of the entire clamping surfaces of the roller units.

If the roller units are provided with lateral guide rollers, the chains can be held accurately on their specified circulating paths, since the rollers can bear and be supported against the guide bars or segments.

The utilisation of the entire surfaces of the roller units in the entraining or clamping zone, can be achieved in a preferred manner by making the widths of the clamping surfaces of the roller units between the pivot points defined by the axes or pins of two adjacent units being equal to the spacing of the chain divisions.

If the roller units have a variable number of support wheels, more than the minimum two wheels or rollers required may then be used if loadings such as bending, pressure, shear and tensile stresses and torsion are to be expected, which exceed the values which can be withstood by only two wheels.

To obtain a noise-damping effect, at least the tensioning segments may be provided with an elastic coating, which moreover keeps the supporting and lateral guide rollers in better contact with the guide track. The rollers press into the elastic coating, which may be for example of polyurethane, and are thus kept continually at the correct rotational speed without slipping, which furthermore contributes to the high speeds and in particular does not require any renewed accelerations. To this extent, an elastic coating of the guide track is preferred wherever small supporting forces have to be accommodated. Where high strip tensions have to be applied, especially in the clamping zone, an uncoated guide track of steel is, however, preferred. In this case, in order to avoid at least the lateral guide rollers running on steel surfaces, an elastic running insert may, for example, be inserted into a lateral groove of the guide track. It projects or extends from the track and thus keeps the rollers turning at the required speed.

For quality monitoring, in particular establishing flatness, a completely unstressed strip is absolutely essential. Since the chain systems which act on the strip immediately after treatment of the strip can cause the strip to be destressed to zero at its inlet to the system, a measuring section may be disposed downstream of the apparatus. This section is preferably on a stand immediately following the outlet end and has a conveyor chain system onto which the strip can be laid for inspection, or which otherwise circulates continuously at the speed of strip movement.

At the strip outlet end of the apparatus, a section comprising rollers for shaping the strip into a tube may advantageously be disposed between the apparatus of the invention and a pipe making machine. Use can be made here of the fact that the strip tensions, possibly as high as 200 tonnes, produce flow of the metal of the strip even in the case of thick strips. The flow or yield process can be utilised for shaping the strip, which can be done with low energy consumption on account of the yield condition.

In order that electric current may be supplied to the strip for galvanic processes, or the strip may be rapidly heated to a desired temperature from ambient temperature in an annealing process, heat-conducting contact surfaces may be fitted to the strip-contacting surfaces of the roller units. For example, the elastic facings of the roller units may be replaced by copper plates, which can transmit large quantities of heat to the strip in a very short time. The current can be applied to the roller units as they run through the clamping zone. This means that current is supplied only during the time when large pressing forces on the strip are present, so that electric arcs and burn stains on the surface of the strip are avoided. Apart from a better efficiency compared with conventional gas or oil-fired annealing plants, one great advantage of this measure lies in the possible switching off of the heat supply at any time. By contrast, an annealing furnace must be maintained uninterruptedly at high temperature even during unavoidable operating pauses, for example at weekends.

BRIEF DESCRIPTION OF THE DRAWINGS

An example of an apparatus in accordance with the invention will now be described with reference to the accompanying drawings in which.

DESCRIPTION OF THE PREFERRED EMBODIMENT

Figure 1:
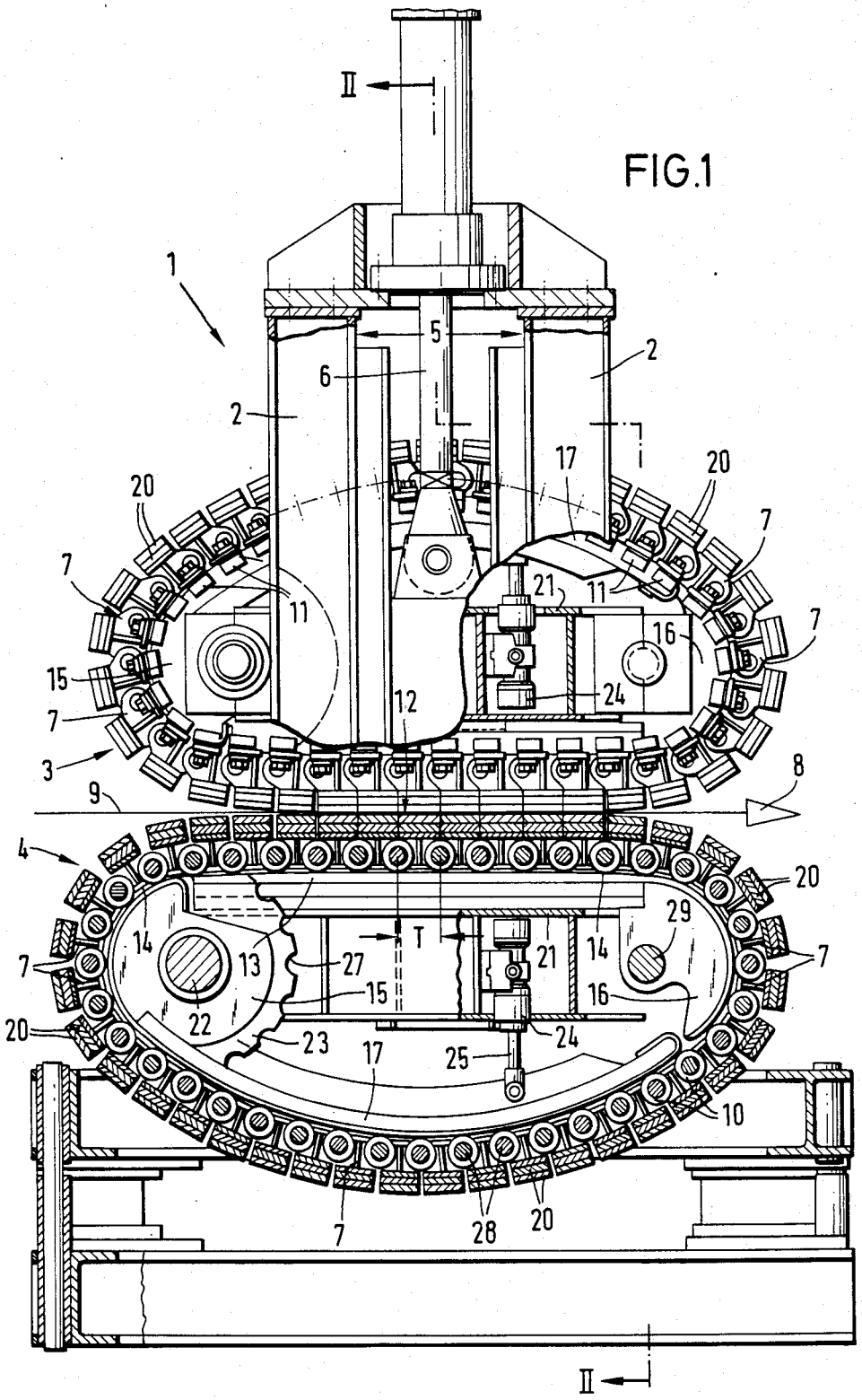
FIG. 1 is a side view of the apparatus in the form of a stand comprising two oppositely situated conveyor chain systems of which an upper chain system is shown partly sectioned and a lower chain system is shown fully sectioned.

Braking and holding-back apparatus 1 comprises two chain systems 3, 4, opposed to each other in two upright frames 2, which are open at the top to facilitate installation and removal of the systems. The chain systems are installed in windows 5 of the upright frames 2, and the upper chain system 3 can be moved upwards and downwards by means of fluid pressure cylinder-operated piston rods 6 with respect to the lower chain system 4.

Figure 2:
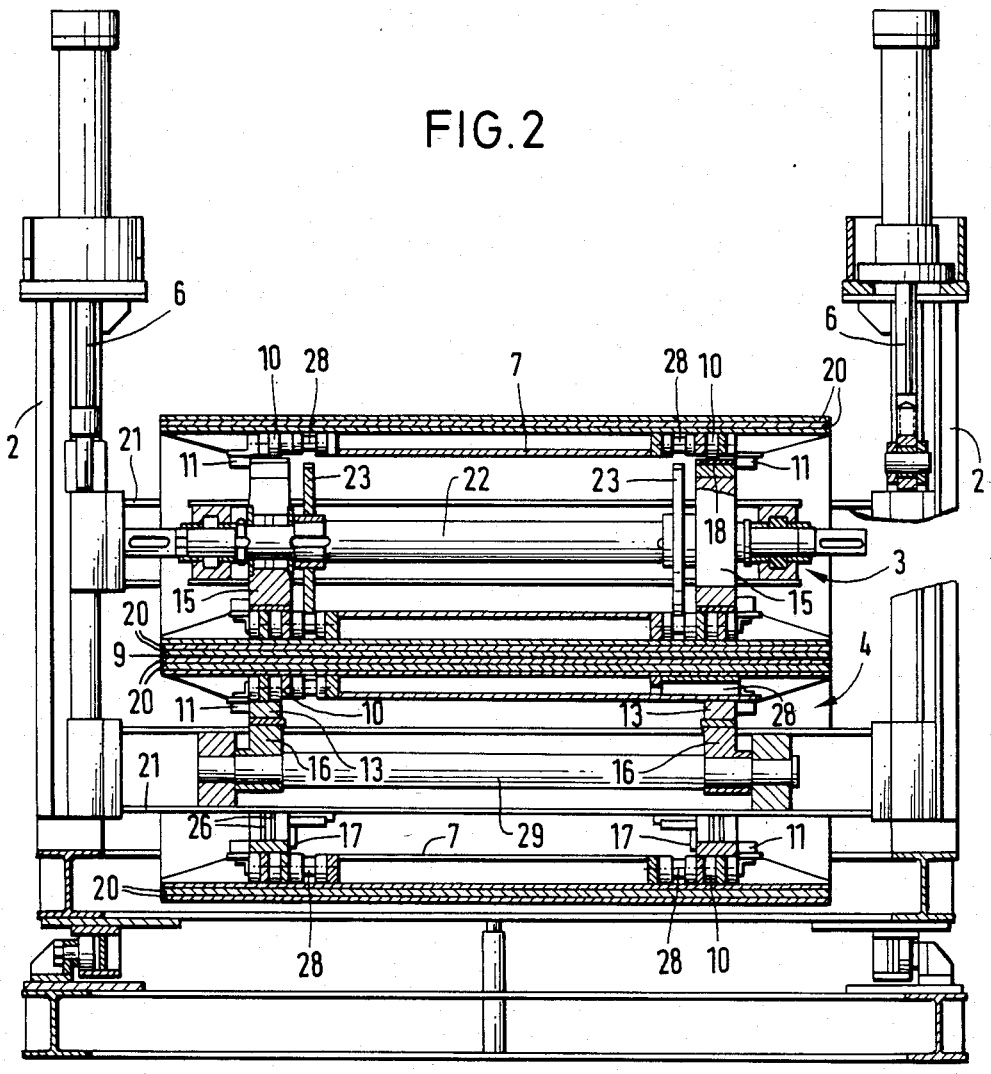
FIG. 2 is a sectional view of the apparatus as seen in the direction of the arrows on the line II—II of FIG. 1.

The chains of the systems 3, 4 are composed of a plurality of coupled together, trolley-like roller units 7, which extend across the entire width of a metal strip 9, which enters the apparatus in the direction of an arrow 8 (FIG. 2). The chains run on guide tracks and are supported laterally against this track by support wheels 10 and lateral guide rollers 11 at least at both sides. Each guide track comprises, in a clamping or entraining zone 12, in which the oppositely situated roller units 7 encompass the strip 9 on both sides and clamp it between them, straight guide bars 13 having inlet and outlet inclined surfaces 14. The track also includes tensioning segments 15 at the inlet end of the clamping zone, direction-changing and guide segments 16 at the outlet end of the clamping zone and outer, circular-arc guide bars 17, situated opposite the clamping zone. The guide tracks of the chains of the systems 3, 4 also have at least in the region of the tensioning segments 15, an elastic coating 18 and, in addition, the surfaces of the roller units 7 are furnished with an elastic coating 20. The clamping surfaces of the roller units 7 have a width in their direction of movement corresponding to the chain pitch or division T, and extend within the pivot axes defined by axles of the support wheels 10 of two adjacent roller units.

The tensioning segment 15 of each chain system 3, 4 is mounted at the strip inlet end pivotally on a chain shaft 22, alongside the chain wheels 23 which drive the chains 3, 4. The chain drive shaft 22 is journalled in a box frame 21, which is surrounded by the circulating chain system. To pivot the segments 15, which tension the chains 3, 4, the outer guide bars 17 merge without an abrupt transition into the tensioning segments 15 and are loaded by stressing fluid pressure cylinders 24, mounted in the upper and lower box frames 21. The cylinders 24 are articulated by piston rods 25 to beams 26 of the outer guide bars 17 and thus exert a lever action on the tensioning segments 15 when the piston rods 25 are adjusted.

The torque which is applied by a drive, which is not shown, to the chain shaft 22 is transmitted by the chain wheels 23 to the chains 3, 4, for which purpose the chain wheels 23 comprise a plurality of semicircular recesses or divisions 27, the dividing error in the location of the recesses being smaller the larger the number of recesses, which receive the axles or pins 28 of the roller units 7. At the outlet end, the chains 3, 4 slide without any drive on the direction-changing and guide segments 16, which are mounted by support axles 29 on the box frames 21.

Figure 3:
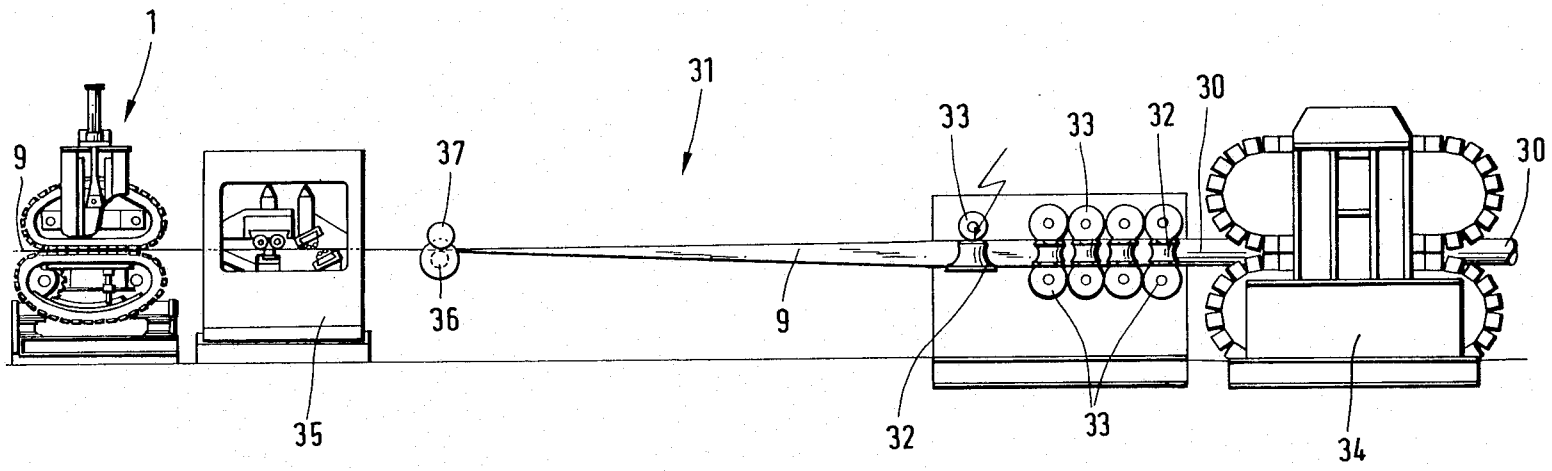
FIG. 3 shows the apparatus to a smaller scale incorporated in plant for making pipes from flat metal strip.

The apparatus 1 described above can, as shown in FIG. 3, be incorporated in plant for forming a tube 30 from the strip 9. The high strip tension brought about by the braking apparatus 1 causes a flow of the metal of the strip and enables the strip 9 to be deformed into a tube without high energy consumption. For this purpose, the apparatus 1 is followed downstream at the outlet end by a shaping section 31 comprising firstly a roller set 36, 37 and then, at a distance, a vertical and a horizontal roller 32, 33, in which a first deformation of the strip 9 takes place. At a further distance downstream in the direction of travel, there is a further roller group consisting of vertical and horizontal rollers 32, 33, encompassing the strip or tube more or less on all sides, and this group finally shapes the strip to form the tube 30. This is followed, for further conveyance of the tube 30, by a known pipe drawing machine 34, which encloses the pipe between oppositely situated, circulating clamping conveyor systems. To enable possible flatness errors of the strip 9 to be eliminated before it is shaped into the tube or pipe 30, a conventional strip straightening machine 35, illustrated in FIG. 3, may be disposed directly downstream of the apparatus 1 and upstream of the shaping section 31.

I claim:

1. In apparatus for exerting a drag upon a moving metal strip, said apparatus comprising two oppositely disposed endless conveyor chain systems, each of said systems comprising conveyor chain means extending around an endless path, at least one chain wheel for controlling the movement of each of said chain means around said path, said chain means of each of said systems including a plurality of coupled roller units, and first guide means for guiding said roller units along a straight drag-applying zone of the endless path in each of said conveyor chain systems with the drag-applying zone having an inlet end and an outlet end relative to the moving metal strip, said apparatus further comprising means mounting said systems with said drag-applying zones of each of said systems being adjacent each other and means for clamping said strip between said roller units of said systems in said drag-applying zones to allow said systems to exert said drag thereon, the improvement comprising second guide means in each of said systems, said second guide means guiding said roller units along another zone of the endless path extending from the outlet end to the inlet end of said drag-applying zone, said second guide means extending in the direction of the endless path between the inlet and outlet ends of said drag-applying zone thereof and said second guide means being curved along the full extent thereof in the direction of the endless path from the outlet end to the inlet end of the drag-applying zones, said first and second guide means guiding said chain means around each of said endless paths, and said second guide means located at the outlet end of said drag-applying zone providing guidance for said chain means and being free of driving engagement with said chain means.

2. Apparatus as claimed in claim 1, in which said at least one chain wheel of each of said systems is disposed at the inlet end of said drag-applying zone.

3. Apparatus as claimed in claim 2, wherein said inlet end of said drag-applying zone is the end towards which said drag applied to said strip is directed.

4. Apparatus as claimed in claim 3, wherein each of said second guide means further comprises at least one circular arc-shaped direction-changing guide segment for each of said conveyor chain systems for guiding and changing the direction of said chain means and means mounting said at least one guide segment at the outlet end of said drag-applying zone remote from said at least one chain wheel located adjacent the inlet end of said drag-applying zone.

5. Apparatus as claimed in claim 4, further comprising an elastic coating on said tensioning segments.

6. Apparatus as claimed in claim 4, in which said first guide means of each of said systems comprises straight inner guide bars within each said endless path and adjacent to and extending in the inlet end-outlet end direction of said drag-applying zone, and said second guide means of each of said systems comprises circular arc-shaped outer guide bars extending in the direction of the endless path and having a first end and a second end, means mounting said outer guide bars opposite said inner guide bars along and within said endless path adjacent the another zone, direction-changing curved tensioning segments for tensioning said chain means, means mounting said tensioning segments at the inlet ends of said drag-applying zones, a drive shaft supporting said at least one chain wheel, said tensioning segments at the inlet end of said zone being pivotally mounted on said drive shaft, and the first end of said outer guide bars merging free of any angular transition into said tensioning segments at said inlet end and said outer guide bars terminating at the second end thereof at a distance from said guide segments at the outlet end of said drag-applying zone remote from said at least one chain wheel.

7. Apparatus as claimed in claim 6, further comprising fluid pressure cylinder means acting on said outer guide bars for tensioning said chain means.

8. Apparatus as claimed in claim 6, wherein said inner guide bars have a first end and a second end and terminate at the first end at a distance from said tensioning segments at the inlet end of said drag-applying zone at which said chain wheel is situated and merge at the second end thereof free of angular transition into the guide segment at the outlet end of said drag-applying zone remote from said at least one chain wheel.

9. Apparatus as claimed in claim 1, wherein said first guide means is operative to cause said chain means including said roller units to enter said drag-applying zone along a path inclined to the direction in which said strip travels through said drag-applying zone.

10. Apparatus as claimed in claim 1, in which said chain means of said chain systems include a different number of roller units from each other.

11. Apparatus as claimed in claim 1, wherein said chain means include lateral guide roller means for guiding said roller units laterally.

12. Apparatus as claimed in claim 1, in which said chain means includes pins pivotally connecting said roller units together to form an endless chain and said roller units including means defining clamping surfaces for engaging and clamping said strip, said clamping surfaces having a width measured along the length of said chain equal to the distance between the axes of adjacent pins connecting adjacent roller units to each other.

13. Apparatus as claimed in claim 1, in which said roller units include a variable plurality of support wheels and means rotatably connecting said support wheels to said roller units for supporting said roller units from said guide means.

14. Apparatus as claimed in claim 1, in combination with a measuring section and means mounting said measuring section downstream of said apparatus in the direction of travel of said strip.

15. Apparatus as claimed in claim 14, in which said measuring section includes a chain conveyor system.

16. Apparatus as claimed in claim 1, in combination with a roller set for shaping said strip into a tube, means mounting said roller set downstream of said apparatus in the direction of movement of said strip, a pipe drawing machine and means mounting said pipe drawing machine downstream of said roller set in the direction of movement of said strip.

17. Apparatus as claimed in claim 1, in which each of said roller units includes means defining a surface for contacting said strip, said surface being made of electrically conducting material

* * * * *